US006250466B1

(12) United States Patent
Ernst

(10) Patent No.: US 6,250,466 B1
(45) Date of Patent: Jun. 26, 2001

(54) HOLDER FOR SOCKET WRENCH AND SOCKETS

(76) Inventor: Gregory R. Ernst, 15735 SE. Bartell Rd., Boring, OR (US) 97009

( * ) Notice: Subject to any disclaimer, the term of this patent is extended or adjusted under 35 U.S.C. 154(b) by 0 days.

(21) Appl. No.: 09/487,202

(22) Filed: Jan. 19, 2000

(51) Int. Cl.[7] ..... B65D 85/28
(52) U.S. Cl. ..... 206/378; 211/70.6
(58) Field of Search ..... 206/349, 372, 206/373, 374, 375, 376, 378, 493; 211/70.6; 294/146, 159, 161, 162, 163

(56) References Cited

U.S. PATENT DOCUMENTS 5,398,823 * 3/1995 Anders ..... 206/378
5,573,116 * 11/1996 Zink ..... 206/378
5,645,177 * 7/1997 Lin ..... 206/378
5,848,694 * 12/1998 Newton ..... 206/373
5,897,001 * 4/1999 Dembicks ..... 206/378
5,975,297 * 11/1999 Kao ..... 206/378
5,992,626 * 11/1999 Anderson ..... 206/378
6,032,797 * 3/2000 Kao ..... 206/378
6,044,985 * 4/2000 Kao ..... 211/70.6
6,095,329 * 8/2000 Kao ..... 206/378

* cited by examiner

*Primary Examiner*—Luan K. Bui
(74) *Attorney, Agent, or Firm*—James D. Givnan, Jr.

(57) ABSTRACT

A rail is provided with a hand grip at one end and serves to receive wrench supports on which ratchet or socket wrenches are stored in parallel with the rail. The wrench supports include U-shaped brackets which may carry wrench extensions. Drive sockets are stored on rail mounted carriers each including a base on the rail, the number of which may be altered to carry a set of drive sockets for use with a ratchet or socket wrench supported by the rail. The drive socket carriers engage a recess in an internal socket wall. A modified form of the holder includes a rail having an irregular edge engaged by a projection on the base of a socket carrier or wrench support to prevent accidental displacement of the base along the rail. The drive socket carriers and wrench supports are preferably of plastic construction having a degree of flexibility. A modified holder dispenses with a hand grip on the rail.

3 Claims, 3 Drawing Sheets

HOLDER FOR SOCKET WRENCH AND SOCKETS

BACKGROUND OF THE INVENTION

The present invention pertains generally to a holder on which may be stored and transported a multitude of sockets as well as a ratchet or socket wrench and extensions.

Socket wrenches and drive sockets usable therewith are commonly stored and transported within tool boxes along with an assortment of other hand tools. Finding the desired wrench and drive socket can incur a certain amount of inconvenience as the drive sockets are frequently mixed with one another and other small hand tools in a tool box. Further, the desired drive socket must be removed from the tool box and examined to insure it is the desired socket for the task at hand. A socket wrench, a collection of drive sockets and one or more wrench extensions may constitute a sizeable quantity of tools so as to take up considerable space in a tool box. As the tools within a tool box are not in clear view to the user, but rather must be removed from the tool box and inspected as to determining size and length of the drive socket, all contribute toward the time required for accomplishing a certain task.

SUMMARY OF THE PRESENT INVENTION

The present invention concerns the external attachment of hand tools, and particularly ratchet wrenches and drive sockets to an elongate base adapted for carrying in one hand.

The present tool holder includes multiple carriers for drive sockets of the type used with ratchet wrenches. The drive sockets are at all times exposed to view to facilitate socket selection. The drive socket carriers include a biased retainer to maintain a socket in place until selected for use. A rail is provided with a hand grip at one end and is of a length to receive multiple socket carriers for supporting a set of drive sockets. Additionally supported by the rail of the present tool holder is a ratchet wrench received within U-shaped brackets in place on the rail. Additionally, provision is made for the placement of one or more extensions which are utilized in conjunction with a ratchet wrench and a drive socket. A modified form of the invention dispenses with the hand grip.

Important objectives of the present invention include the provision of a tool holder of elongate shape suited for the transport of a multitude of drive sockets, a ratchet wrench and an extension for convenient transport to a work site and ready assembly of the wrench and drive socket; the provision of a tool holder utilizing a rail on which are carried both wrench supports and socket carriers at all times open to view of the user to facilitate proper selection, removal and assembly of the desired ratchet tool; the provision of a tool holder having components which lend themselves to manufacture by low cost high production techniques to render a low cost of manufacture.

DETAILED DESCRIPTION OF THE PREFERRED EMBODIMENTS

Figure 2:
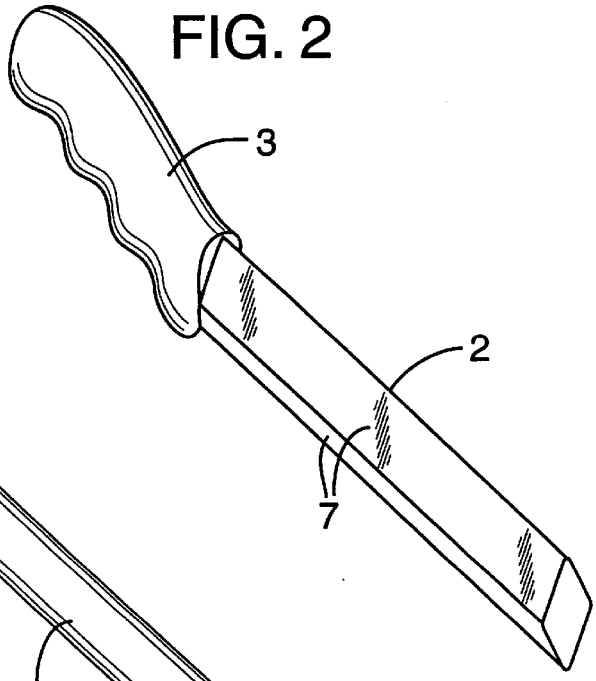
FIG. 2 is a perspective view of a rail of the present tool holder.
Figure 1:
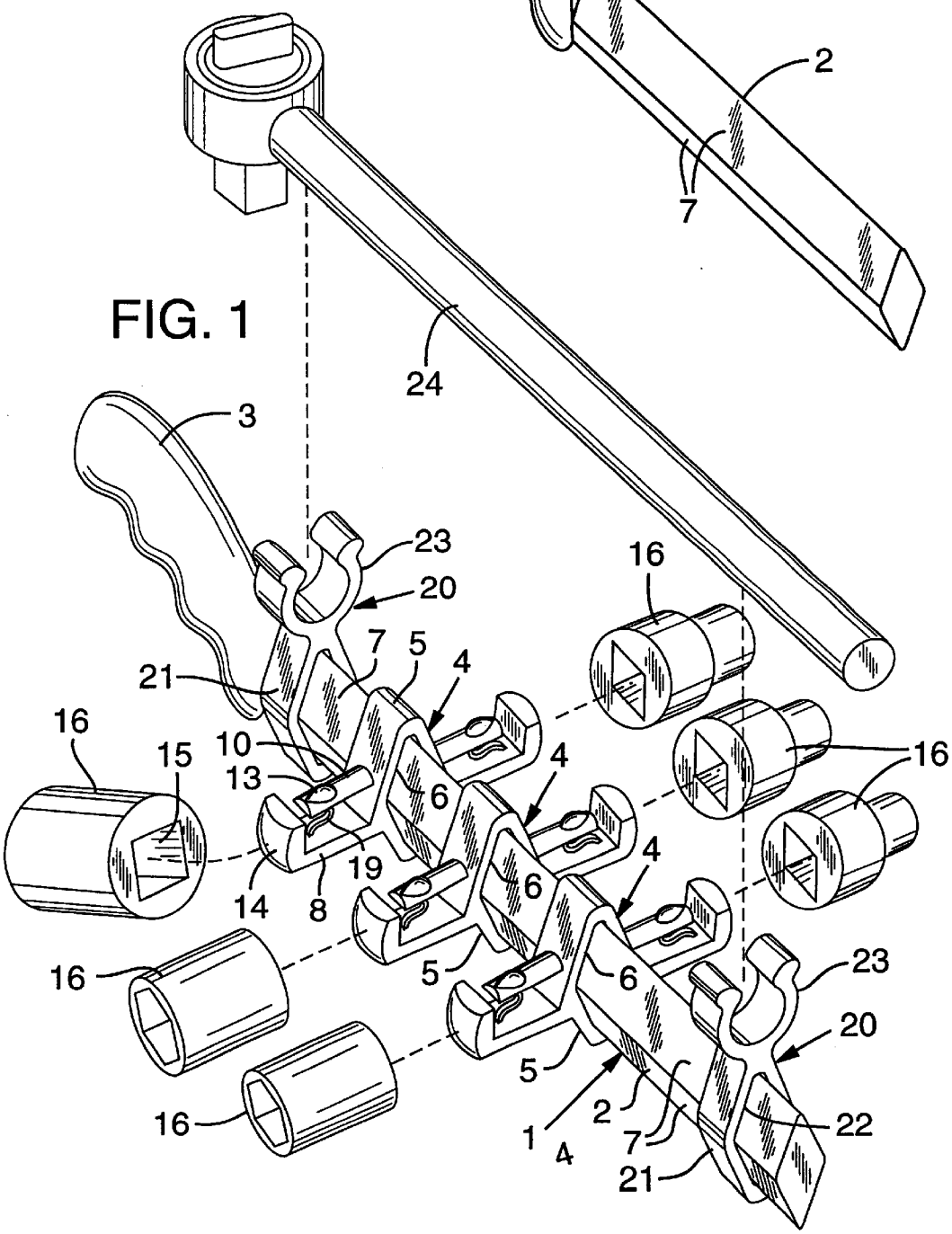
FIG. 1 is a perspective view of one embodiment of the present tool holder with parts exploded away for purposes of illustration.
Figure 3:
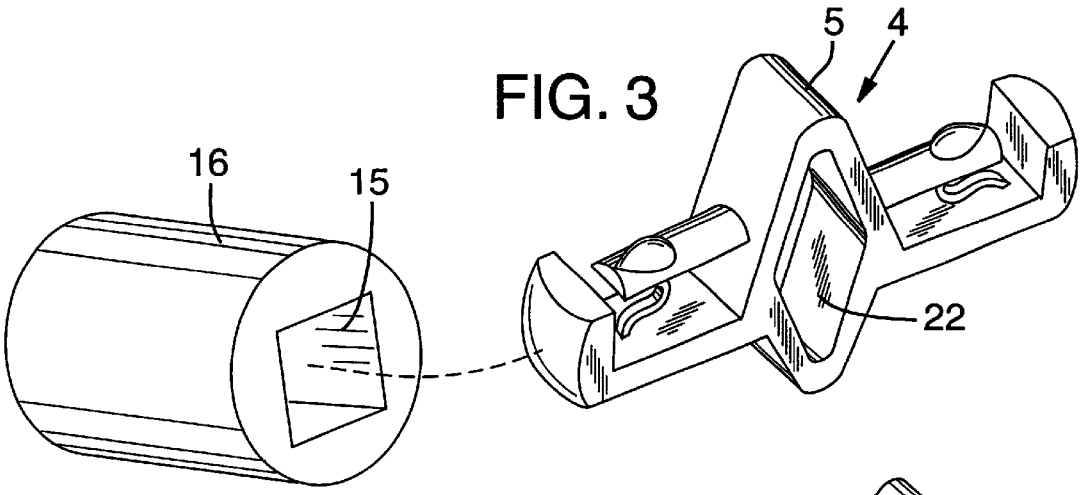
FIG. 3 is an enlarged perspective view of a socket carrier.

With continuing attention to the drawings wherein reference numerals indicate parts similarly hereinafter identified, the reference numeral 1 indicates generally the present hand tool holder.

The reference numeral 2 indicates a rod or rail of the holder terminating at one end in securement to a hand grip 3 in a preferred form of the holder.

Socket carriers generally at 4 are spaced along rod or rail 2 and include a base 5 which defines an opening 6 to enable a snug yet adjustable fit with rod 2. Preferably rod 2 includes one or more flats 7 to retain the socket holders in aligned relationship with one another. Base 5 of each socket holder supports a post 8 and an arm 10, the latter being of flexible construction to bias a boss 13 on the arm into seated engagement with a recess (not shown) found on most all internal socket walls for ratchet wrench drive stud engagement. Post 8, arm 10, boss 13 and a spring 19 are parts of a drive socket holder, the subject of a co-pending U.S. patent application Ser. No. 09/309,392, U.S. Pat. No. 6,092,655. The posts 8 include a square head 14 for occupying square recess 15 of a drive socket 16. The rod or rail 2 and socket carrier base 5 are correspondingly shaped and sized to prevent undesired displacement of the socket carrier along the rod.

Wrench supports generally at 20 include a base 21 defining an opening 22 for, snug engagement with rod 2 and include a U-shaped bracket at 23 for reception of a ratchet or socket wrench 24. The U-shaped brackets 23 are preferably of molded plastic construction permitting lateral flexure for insertion of a ratchet wrench handle by pressing same into seated engagement with the bracket.

Figure 4:
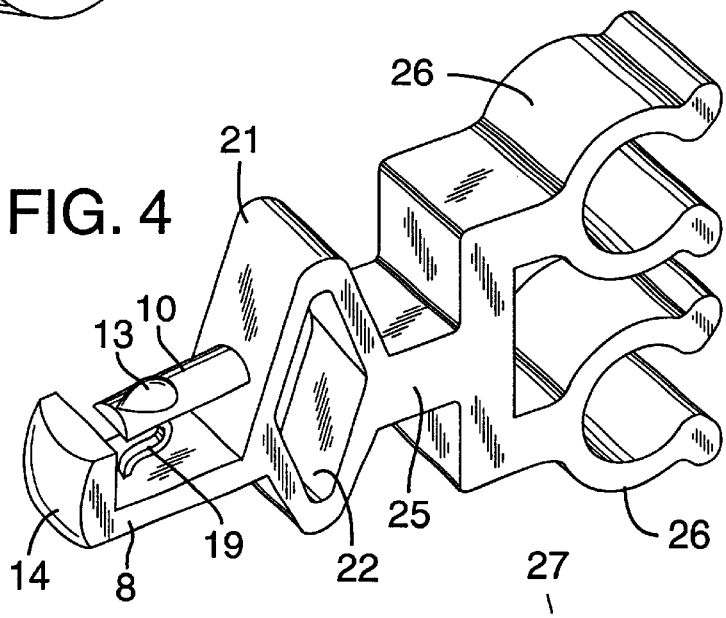
FIG. 4 is a similar view showing a combination socket carrier and wrench support.

The present tool may include combination wrench and drive socket carriers generally of the type shown in FIG. 4 wherein a base 21 has an opening 22 for reception of rod 2 and includes both a post 8 and an arm 10 of the type earlier described for reception of a drive socket while an oppositely disposed wrench support at 25 includes U-shaped brackets 26. Such a combination unit would be utilized along with a second like unit spaced along rod 2 to support the remaining end of a ratchet wrench handle or an extension.

Figure 5:
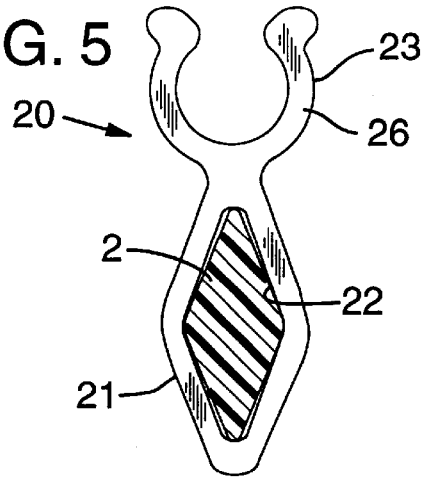
FIGS. 5 and 6 show in elevation wrench and extension supports in place on a sectional rail segment.
Figure 6:
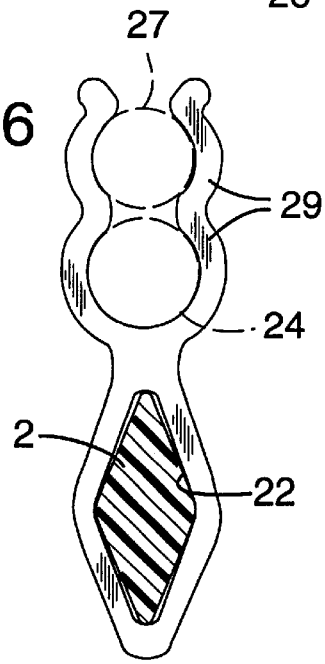
Figure 7:
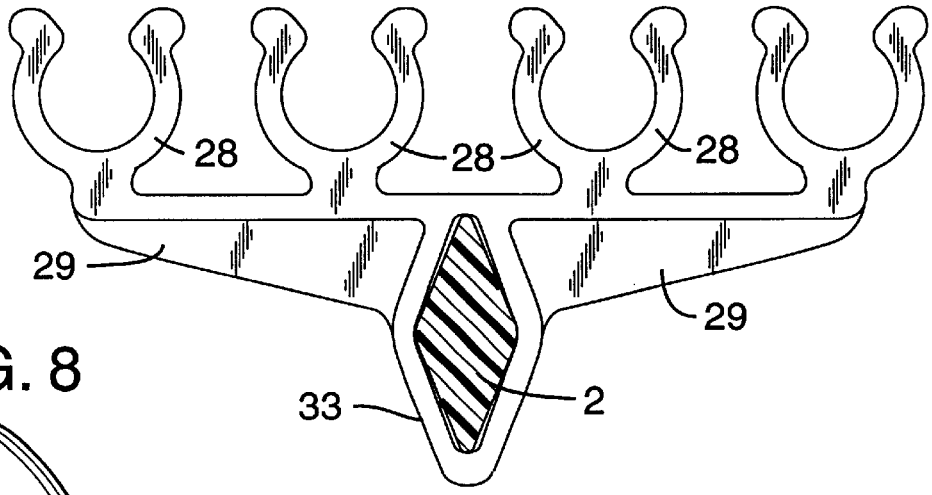
FIG. 7 is a view showing a wrench support in elevation on which multiple wrenches and extensions may be carried.
Figure 8:
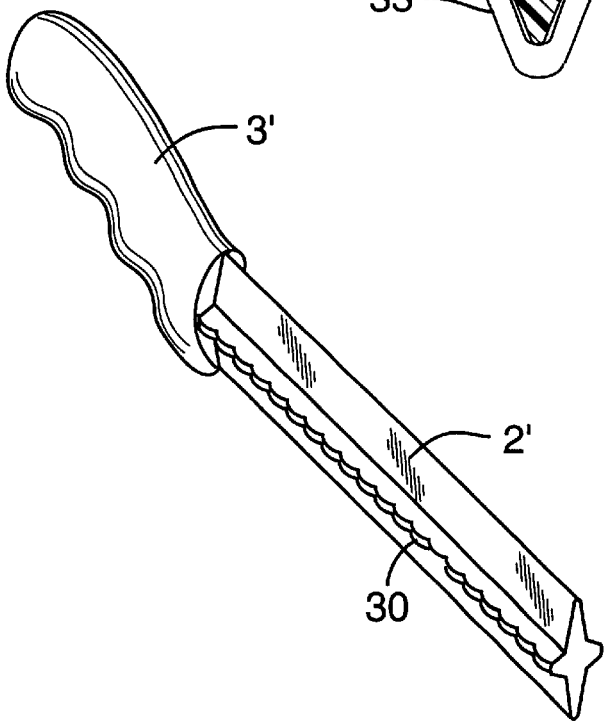
FIG. 8 is a perspective view of a modified rail of the present tool holder having an irregular edge therealong.
Figure 9:
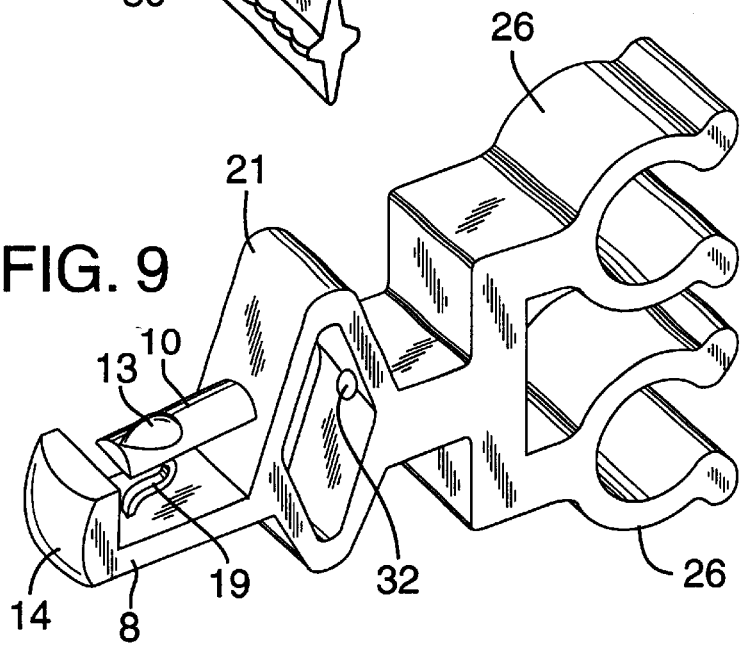
FIG. 9 is a perspective view of a combination socket carrier and wrench support with a modified base for installation on the modified rail shown in FIG. 8.

FIGS. 5 and 6 show modified wrench supports respectively for single and double wrench or extension reception in a double bracket at 29. FIG. 7 provides U-shaped brackets 28 for several wrench handles or extensions with braces 29 being integral with a base 30. In FIGS. 8 and 9 a modified holder is shown wherein a rail 2' has an irregular edge 30 which may be of a scallop. A base 31 for positioning along the rail has a projection 32 which engages edge 30 and accordingly serves to retain base along the rail 31 in place until sufficient manual force is exerted on the base to relocate the base. Base 31 may alternatively be part of a socket carrier 4 or a wrench support 20 of the type earlier described or a combination thereof A second form of the invention dispenses with hand grip 3. Accordingly, the holder may be grasped directly about the rod or rail 2 or a tool component attached thereto or conveniently transported in a tool box where space is often critical.

While I have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A tool holder for a wrench and drive sockets and comprising, a rail having longitudinal axis, said rail including an irregular surface oriented lengthwise of the rail, a hand grip integral with an end of the rail, drive socket carriers each having a base defining an opening and extending about said rail, said base of each of said socket carriers having a projection thereon engageable with the irregular surface to restrict socket carrier travel along the rail against all but intentional displacement, wrench supports each having a base defining an opening and extending about said rail, and interengageable surfaces on said rail and said drive socket carriers retaining the latter against displacement about the longitudinal axis of said rail.

2. The tool holder claimed in claim 1 wherein said irregular surface is a series of scallops.

3. A tool holder for a wrench and drive sockets and comprising, a rail having a longitudinal axis, said rail including an external irregular surface orientated lengthwise of the rail, drive socket carriers each having a base in place on and extending about said rail, said base of each of said socket carriers having projection thereon engageable with said irregular surface, wrench supports each having a base in place on and extending about said rail, and interengageable surfaces on said rail and the base of each of said drive socket carriers retaining the carriers against displacement about the longitudinal axis of said rail.

* * * * *